US005577783A

United States Patent [19]

Kaminski

[11] Patent Number: 5,577,783

[45] Date of Patent: Nov. 26, 1996

[54] DOOR LOCK DESIGN

[76] Inventor: Michael Kaminski, 11744 Bellagio Rd., Los Angeles, Calif. 90049

[21] Appl. No.: 422,132

[22] Filed: Apr. 13, 1995

[51] Int. Cl.[6] ..... E05C 17/16

[52] U.S. Cl. ..... 292/268; 292/262; 292/270

[58] Field of Search ..... 292/268, 270, 292/262, 278

[56] References Cited

U.S. PATENT DOCUMENTS

| | | | |
|---|---|---|---|
| 781,743 | 2/1905 | Royce | 292/268 |
| 2,548,681 | 4/1951 | Oswald | 292/262 X |
| 2,562,916 | 8/1951 | Hoffman | 292/262 X |

FOREIGN PATENT DOCUMENTS

| | | | |
|---|---|---|---|
| 357492 | 8/1922 | Germany | 292/268 |
| 3415378 | 11/1985 | Germany | 292/270 |
| 257738 | 3/1928 | Italy | 292/268 |
| 2068451 | 8/1981 | United Kingdom | 292/268 |

*Primary Examiner*—Rodney M. Lindsey

*Attorney, Agent, or Firm*—Blakely, Sokoloff, Taylor & Zafman

[57] ABSTRACT

A door lock that has a locking member which cooperates with a latching mechanism to secure a door in a closed position. The locking member also cooperates with a U-shaped plate to limit the movement of the door in a partially opened position. The locking member is attached to the door. The U-shaped plate and latching mechanism are coupled to a wall by a mounting bracket and a hinge. The hinge has an inner sleeve that is attached to a hinge pin and a rotatable outer sleeve which has a slot and a spring loaded button. The spring loaded button can cooperate with a notch in the inner sleeve to lock the position of the outer sleeve. When the door is closed, the locking member rotates the outer sleeve until the button is captured by the notch of the inner sleeve. The slot of the outer sleeve captures the locking member and prevents the door from being opened until the button is released from the inner sleeve notch.

5 Claims, 6 Drawing Sheets

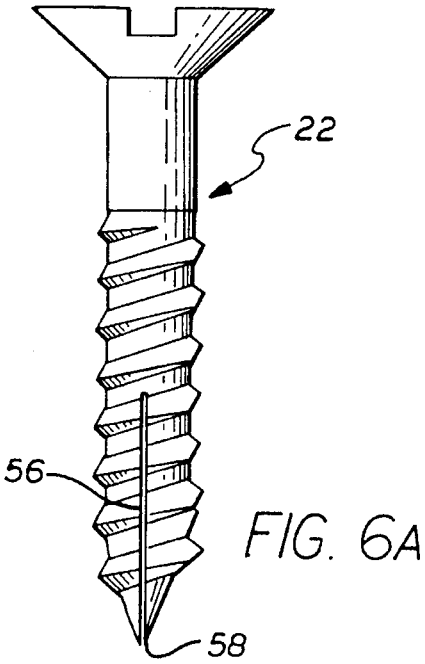
FIG. 6A
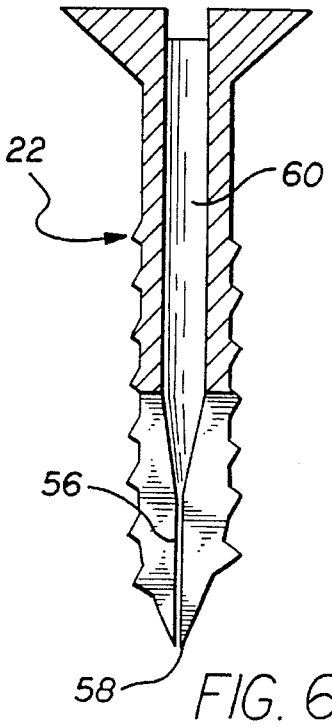
FIG. 6B
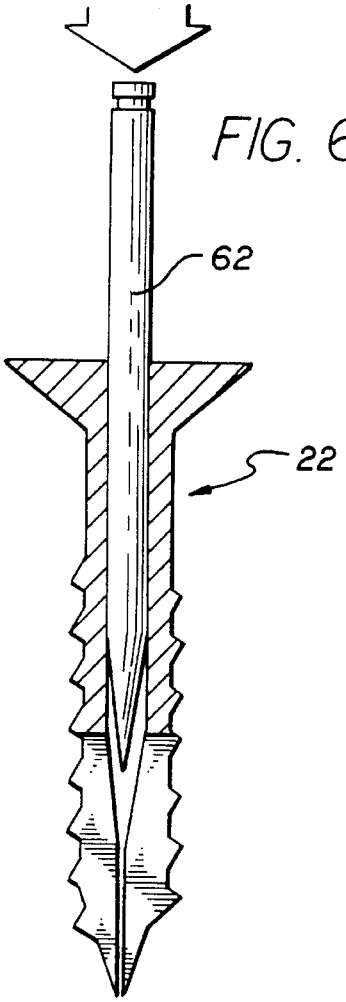
FIG. 6C
FIG. 6D
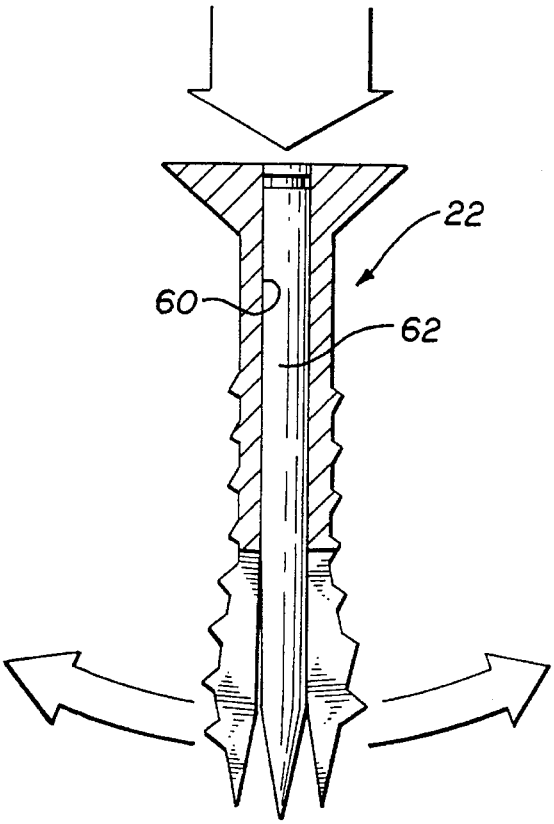

DOOR LOCK DESIGN

BACKGROUND OF THE INVENTION

1. Field of the Invention

The present invention is a self locking door lock.

2. Description of Related Art

It is usually desirable to provide some type of safety device on a door to prevent unwanted intruders from entering the structure. One common type of safety device is the dead bolt lock. Although effective in securing the door, the occupant of the structure is unable to view a visitor unless they unlock the device and open the door. To compensate for this deficiency some doors contain a peep hole which allows the occupant to view the person on the other side of the door. Alternatively, some structures are equipped with a chain which allows the door to be opened a predetermined distance so that the occupant can view the visitor. Conventional chain locks are relatively weak and can be broken by an intruder with a swift kick to the door. It is therefore desirable to have a door check which can withstand an excessive force applied to the door.

U.S. Pat. No. 540,019 issued to Gay and U.S. Pat. No. 222,338 issued to Wittich disclose door checks that cooperate with a dead bolt lock to secure the door in a slightly opened position. The door checks include a latch that is constructed from a solid metal plate or bar which increases the strength of the assembly. The latches are typically mounted to the structure with wood screws attached to a mounting bracket. It has been found that an intruder can separate the screws from the wall by applying a large force to the door. It would therefore be desirable to provide a door lock that is strong enough to withstand any bodily force and would allow the occupant to slightly open the door while in the locked position.

SUMMARY OF THE INVENTION

The present invention is a door lock that has a locking member which cooperates with a latching mechanism to secure a door in a closed position. The locking member also cooperates with a U-shaped plate to limit the movement of the door in a partially opened position. The locking member is attached to the door. The U-shaped plate and latching mechanism are coupled to a wall by a mounting bracket and a hinge. The hinge has an inner sleeve that is attached to a hinge pin and a rotatable outer sleeve which has a slot and a spring loaded button. The spring loaded button can cooperate with a notch in the inner sleeve to lock the position of the outer sleeve. When the door is closed, the locking member rotates the outer sleeve until the button is captured by the notch of the inner sleeve. The slot of the outer sleeve captures the locking member and prevents the door from being opened until the button is released from the inner sleeve notch.

BRIEF DESCRIPTION OF THE DRAWINGS

The objects and advantages of the present invention will become more readily apparent to those ordinarily skilled in the art after reviewing the following detailed description and accompanying drawings, wherein:

FIG. 6*a* is a side view of a mounting screw for the door lock;

FIG. 6*b* is a cross-sectional view of the mounting screw of FIG. 6*a;*

FIG. 6*c* is a view similar to FIG. 6*b* showing a pin being inserted into a bore of the screw;

FIG. 6*d* is a view similar to FIG. 6*c* showing the pin fully inserted to expand the screw;

DETAILED DESCRIPTION OF THE INVENTION

Figure 1:
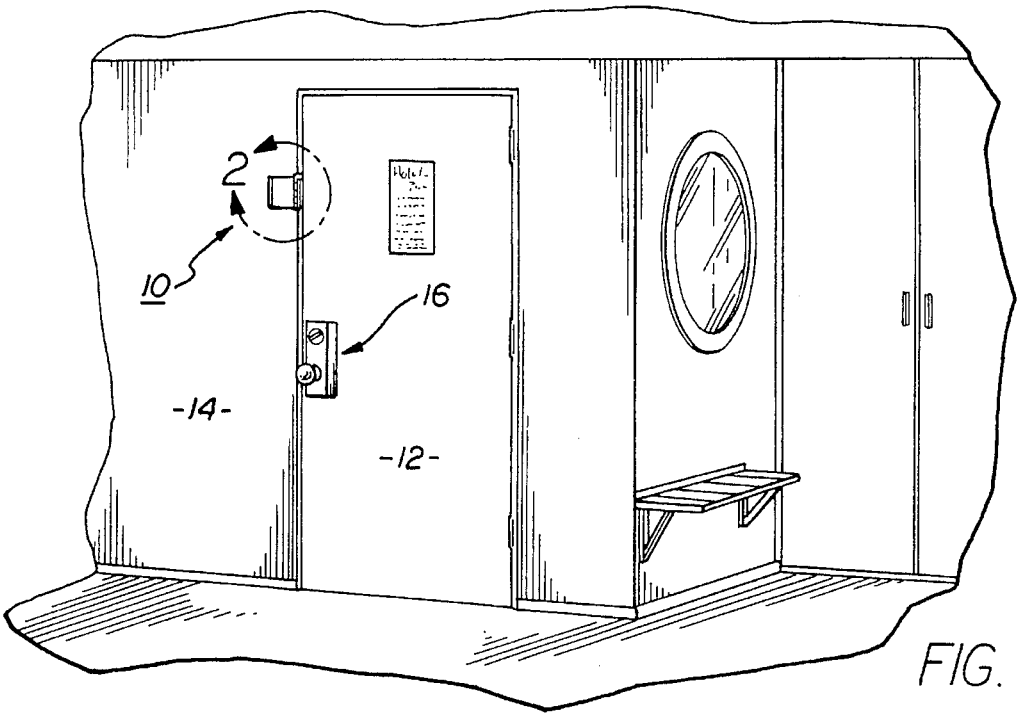
FIG. 1 is a perspective view showing a door lock of the present invention installed onto a door.

Referring to the drawings more particularly by reference numbers, FIG. 1 shows a door lock 10 of the present invention. The door lock 10 is typically mounted to a door 12 and an adjacent wall structure 14. The door lock 10 is constructed to allow the occupant of the structure 14 to open the door 12 a predetermined distance while preventing an intruder from pushing the door open and entering the room. Additionally, when the door lock 10 is in the set position, the lock 10 automatically engages and prevents the door from being opened by an intruder. The lock 10 is particularly useful in providing a back-up safety device to the locks 16 that are typically incorporated into the door 12.

Figure 2:
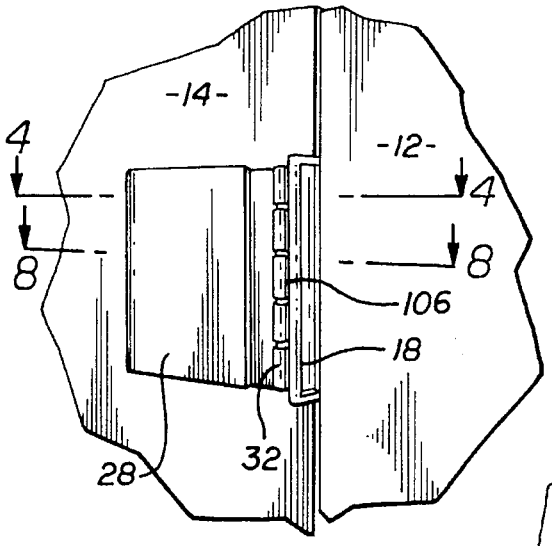
FIG. 2 is a perspective view of the door lock in an unset position.
Figure 4:
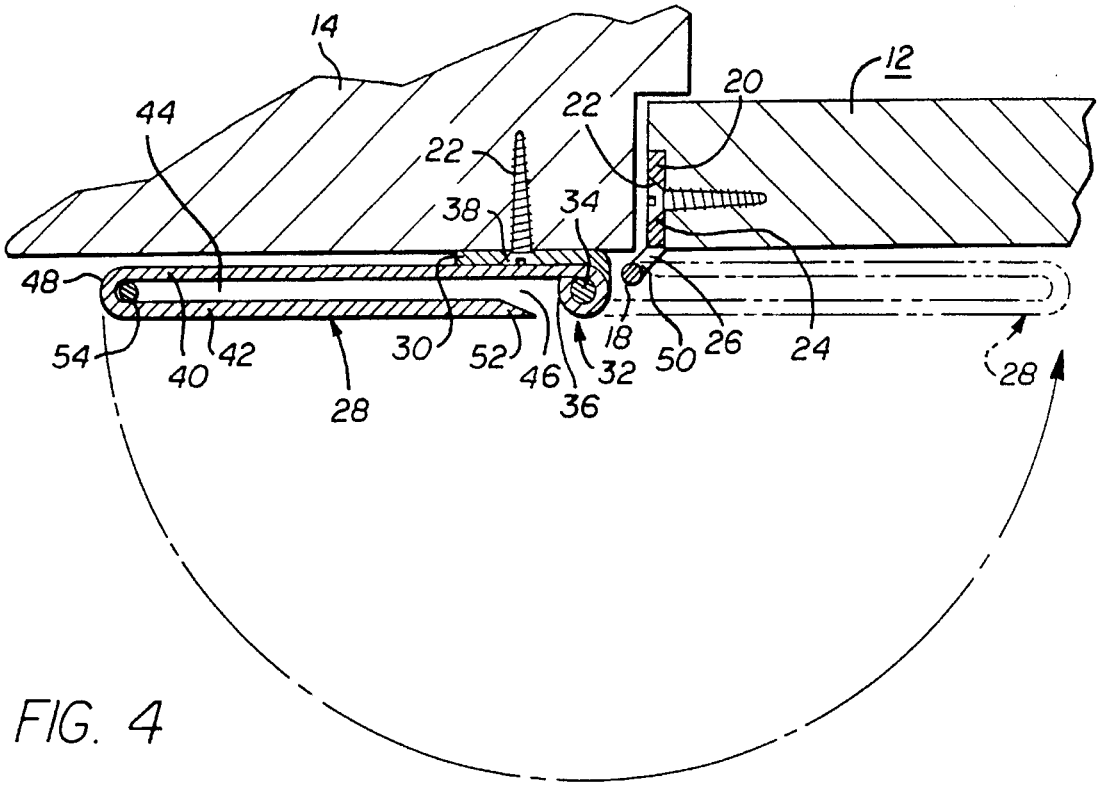
FIG. 4 is a cross-sectional view of the door lock taken at line 4—4 of FIG. 2.

FIGS. 2 and 4 show the door lock 10 in the unset position. The door lock 10 includes a locking member 18 that extends from a locking member mounting bracket 20. The mounting bracket 20 is attached to the door 12 by a plurality of mounting screws 22 that extend through apertures 24 in the bracket 20. The locking member 18 is typically constructed from a stainless steel rod that is bent into a U shaped handle. The U shaped locking member 18 defines a gap 26 between the member 18 and the end of the door 12.

The door lock 10 also has a latch 28 that is coupled to a latch mounting bracket 30 by a hinge 32. The hinge 32 is created by a hinge pin 34 that is inserted into a plurality of aligned fingers 36 that extend from the latch 28 and mounting bracket 30. The mounting bracket 30 is attached to the wall 14 by a plurality of mounting screws 22 that extend through a number of corresponding apertures 38 in the bracket 30. The latch 28 is preferably constructed from a stainless steel plate that is bent into a U shape. The plate has a first wall 40 that extends from the hinge 32 and a second wall 42 that extends from the first wall 40. The walls define a slot 44 that has an opening 46 and a base 48.

Figure 3:
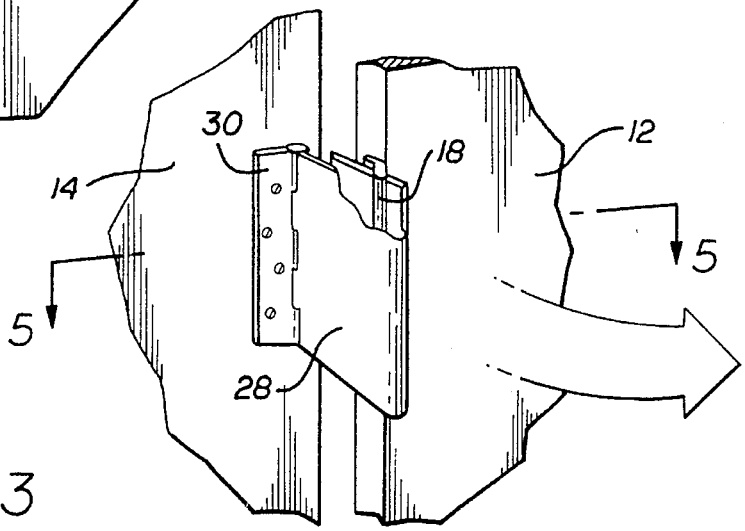
FIG. 3 is a view similar to FIG. 2 showing the door lock in a set position.
Figure 5:
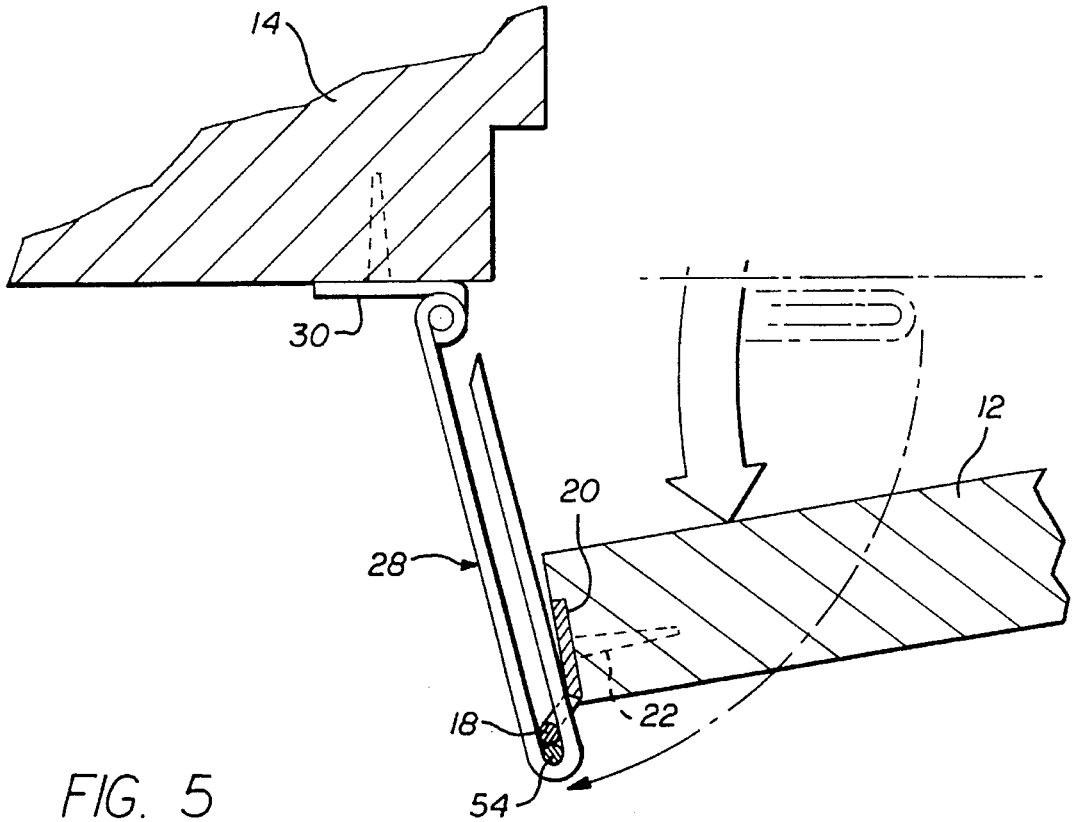
FIG. 5 is a cross-sectional view of the door lock taken at line 5—5 of FIG. 3.

When the latch 28 is rotated into the set position shown in FIG. 2 in phantom, the end 52 of the second wall 42 is adjacent to the locking member 18. As shown in FIGS. 3 and 5, when the door 12 is opened, the locking member 18 moves along the slot 44 until the locking member 18 reaches the base 48 of the latch 28. The engagement of the locking member 18 and the latch 28 prevents further movement of the door 12. The end 50 of the second wall 40 preferably has a chamfer 52 that facilitates the introduction of the locking member 18 into the slot 44. The base 48 of the latch 28 may also have a rubber bumper 54 which absorbs the force of the locking member 18.

FIGS. 6*a*–6*d* show a preferred embodiment of the mounting screw 22 and a method for mounting the screw 22 into a structure. Each screw 22 has a slit 56 that extends from the screw tip 58 to an inner bore 60. After the screw 22 is screwed into the structure, a pin 62 is inserted into the inner bore 60. The pin 62 has an outer diameter that is larger than the inner diameter of the bore 60, so that when the pin 62 is fully inserted into the bore 60, the end of the screw 22 is expanded as shown in FIG. 6*c*. Expansion of the screw further embeds the threads into the structure and improves the strength of the overall door lock assembly. The combination of the steel plate 28 and the expanded screws 72 provide a door lock 10 which is significantly stronger than locks in the prior art.

Figure 7A:
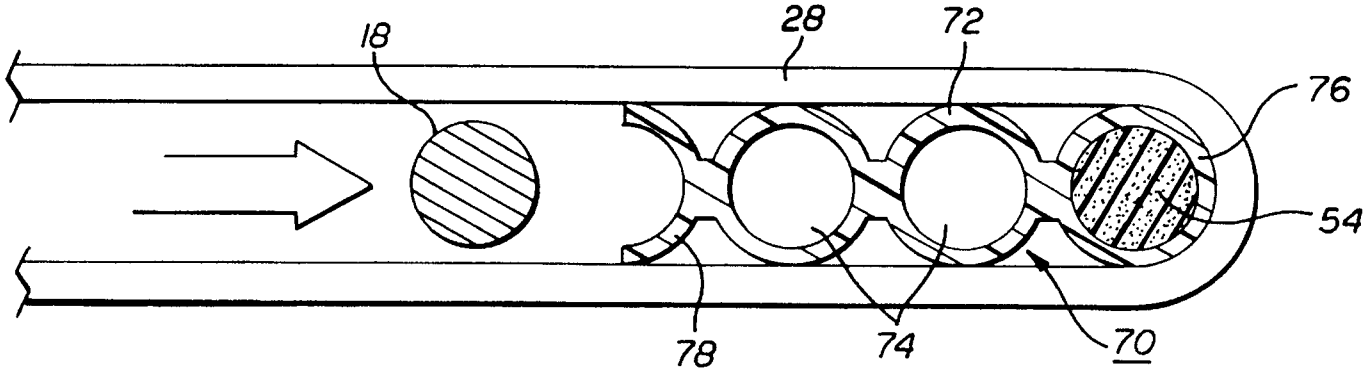
FIG. 7*a* is a top view of an alternate embodiment of the door look with a shock absorbing member located within a latch member.
Figure 7B:
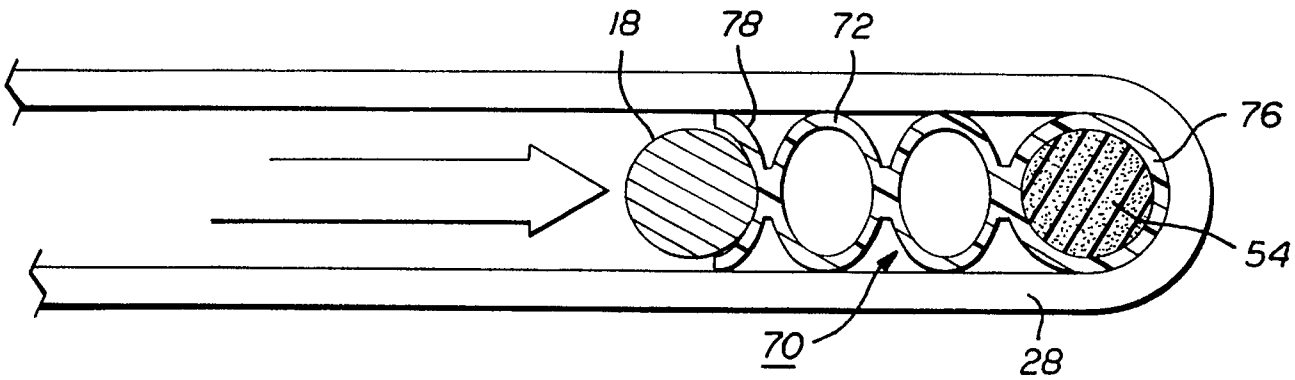
FIG. 7*b* is a view similar to FIG. 7*a* showing a locking member engaging the shock absorbing member.

FIG. 7 shows an alternate embodiment of the door look which has a shock absorbing member 70 located within the latch 28. The shock absorbing member 70 has an outer shell 72 typically constructed from a PVC material. The shell 71 has two hollow members 74 and a member 76 which contains the rubber bumper 54. The shell 72 also has a cup 78 that is adapted to capture locking member 18. As shown in FIG. 8, when the door is opened and the lock in the set position, the locking member 18 engages the cup 78 and compresses the shell 72. The shock absorbing member 70 dampens the force of locking member 18, thereby reducing the wear on the plate and the noise of the lock.

Figure 8A:
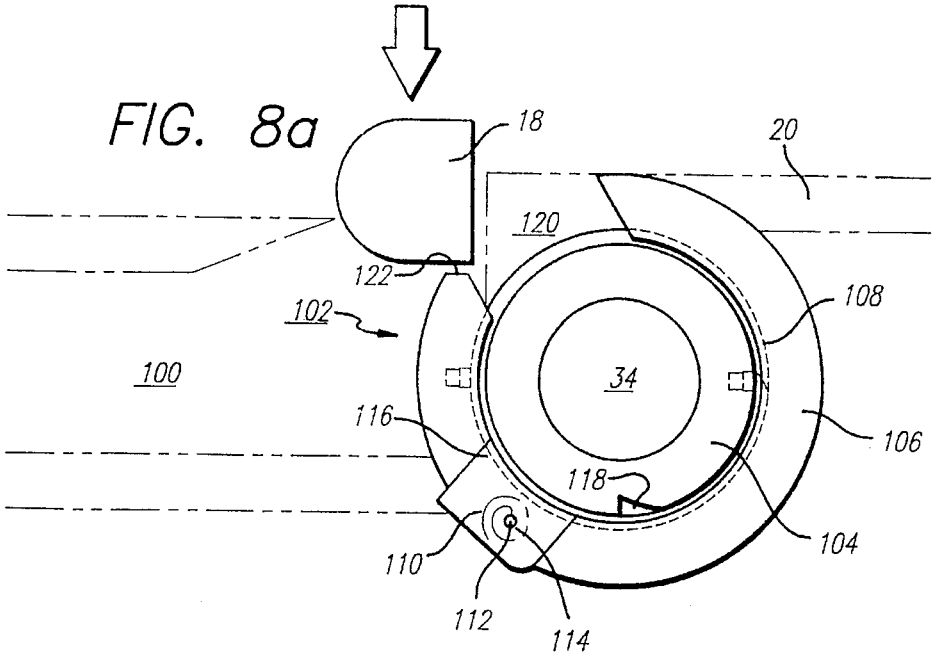
FIG. 8*a* is a top sectional view of an alternate embodiment of the door lock.
Figure 8B:
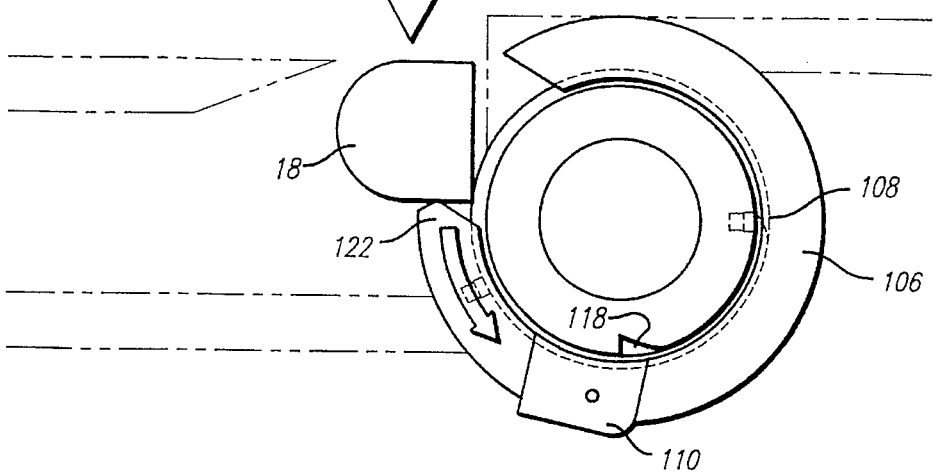
FIG. 8*b* is a top sectional view similar to FIG. 8*a* showing a door element engaging a spring loaded latch mechanism.
Figure 8C:
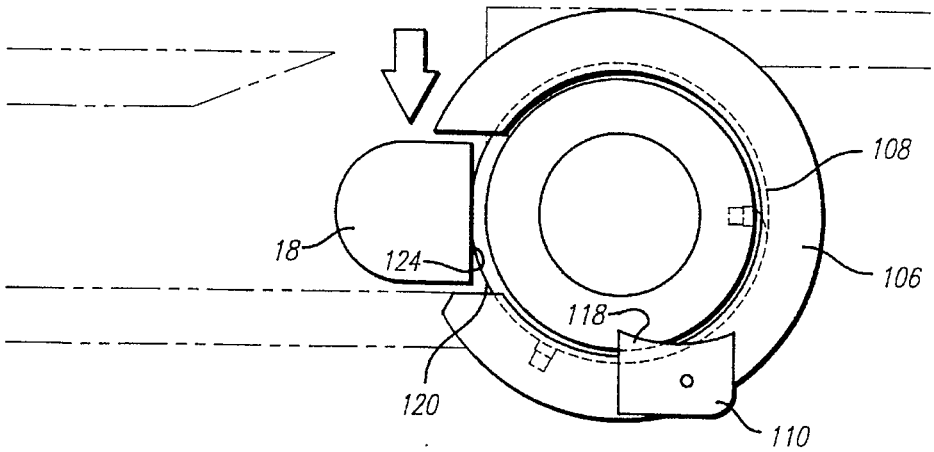
FIG. 8*c* is a top sectional view similar to FIG. 8*b* showing the door element locked by the latching mechanism.
Figure 9A:
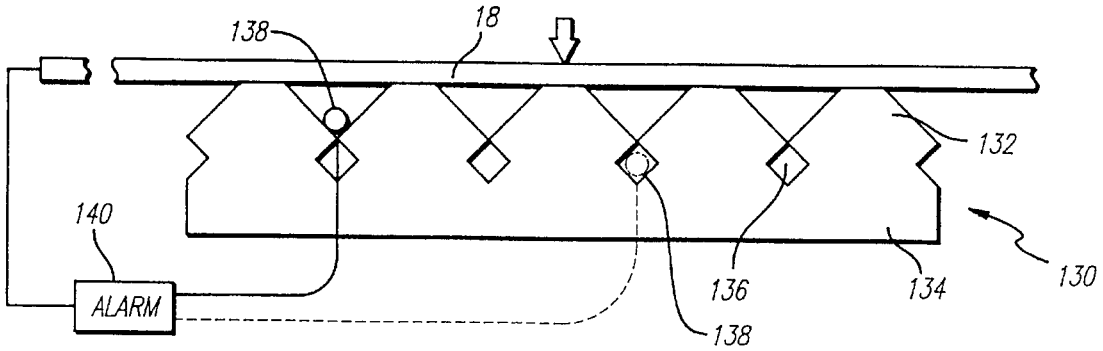
FIGS. 9*a–d* are side views showing a shock absorber being deflected by the locking member.
Figure 9B:
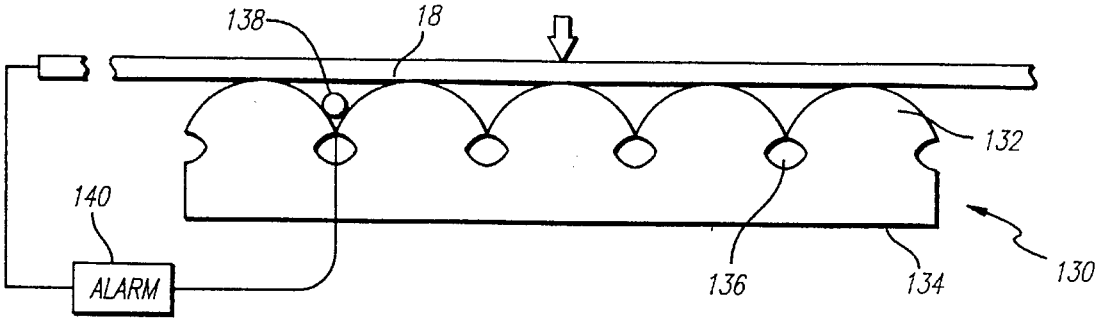
Figure 9C:
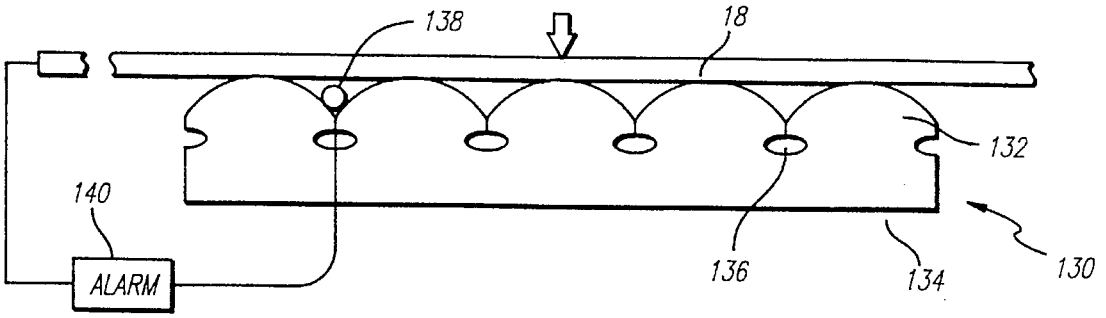
Figure 9D:
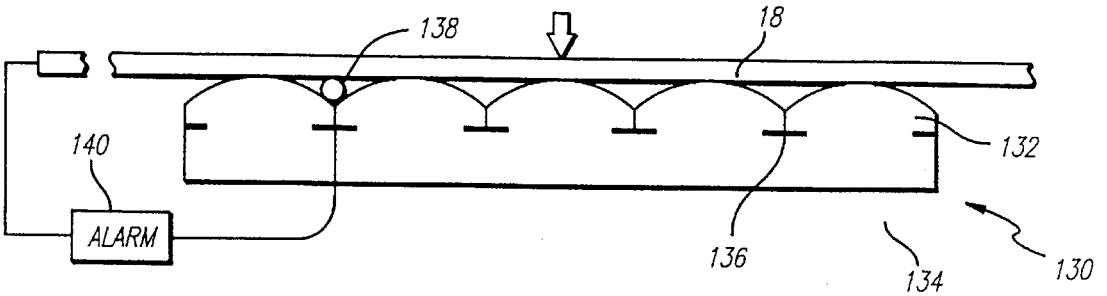

FIGS. 8*a*–*c* shows a door lock 100 which has a locking latch assembly 102 that maintains the door 12 in a closed position. The assembly 102 includes an inner sleeve 104 that is fixed to the hinge pin 34 which couples the latch 28 to the latch mounting bracket 30. Concentric with the hinge pin 34 is an outer sleeve 106 which can rotate relative to the inner sleeve 104. The outer sleeve 106 is biased into the position shown in FIG. 8*a* by a torsion spring 108.

The assembly 102 includes a release button 110 that is pivotally attached to the outer sleeve 106 by pin 112. The button 110 is biased in a clockwise direction by a spring 114. The release button 110 has a leading edge 116 which can cooperate with a notch 118 in the inner sleeve 104 to secure the outer sleeve 106 in the locked position shown in FIG. 8*c*. The button 110 can be released from the notch 118 by pushing an edge of the button and overcoming the biasing force of spring 114.

The outer sleeve 106 has a slot 120 which rotates relative to the inner sleeve 104 and provides clearance for the locking member 18. The slot 120 is partially defined by a cam surface 122 located along an edge of the outer sleeve 106. The cam surface 122 can be engaged by the locking member 18 so that the outer sleeve 106 is rotated in a counterclockwise direction and the button 110 engages the notch 118 of the inner sleeve 104. Referring to FIG. 2, the outer sleeve 106 is typically located at the middle finger of the door lock assembly.

In operation, the locking member 18 is moved in a direction to close the door as indicated by the arrow in FIG. 8*a*. As shown in FIG. 8*b*, further movement of the door 12 causes the locking member 18 to engage the cam surface 122 and rotate the outer sleeve 106. As shown in FIG. 8*c*, the locking member 18 rotates the sleeve 106 until the door 12 is in the closed position. The leading edge 116 of the button 110 is retained by the notch 118 to prevent subsequent rotation of the outer sleeve 106. The locking member 18 is captured by the slot 120 of the outer sleeve 106, thereby preventing the door 12 from being opened until the button 110 is released from the notch 118. The locking member 18 may have a flat surface 124 that provides clearance for the member 18 within the slot 120. When the button 110 is released from the notch 118, the door 12 can be opened and the torsion spring 108 moves the outer sleeve 106 back to the original position.

FIGS. 9*a*–*d* show a preferred embodiment of a shock absorber 130. The shock absorber 130 preferably has a plurality of octagonally shaped protrusions 132 that extend from a base portion 134. The base of each protrusion 132 has a rectangular shaped slot 136. The protrusions 132 are deflected by the locking member 18 as the door is swung toward an open position. The shock absorber 130 is constructed from a damping material which absorbs the force of the locking member 18. The inclusion of the slots 136 and the octagonal shape of the protrusions allow the protrusions 132 to laterally expand when deflected by the locking member 18.

The lock 10 may have an electrical contact 138 located within a groove of the shock absorber 130. The contact 138 may also be embedded into one of the slots 136. The contact 138 and locking member 18 can be connected to an alarm 140. When the door 12 is opened, the locking member 18 deflects the shock absorber 130 and becomes coupled to the contact 138 to close the circuit of the alarm 140. An alarm signal is generated if the alarm 140 is armed. The present invention thus provides a door lock which incorporates dual locking features and an alarm.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. Although a door is described and shown, it is to be understood that the lock can be used on windows, sliding glass doors, etc.

What is claimed is:

1. A door lock assembly that locks a door to a wall, comprising:

a locking member that is attached to the door;

a U-shaped plate that has a slot which receives said locking member and a base portion that limits a travel of said locking member and the door;

a hinge that attaches said U-shaped plate to the wall, said hinge including;

a hinge pin;

an outer sleeve that is rotated to a locked position by said locking member when the door is moved to a closed position, said outer sleeve having a slot which captures said locking member when said outer sleeve is in the locked position;

a locking element that locks said outer sleeve when the door moves to the closed position and said locking member rotates said outer sleeve.

2. The assembly as recited in claim 1, wherein said locking element is a button that engages a notch fixed to said hinge pin.

3. The assembly as recited in claim 2, wherein said hinge further includes an inner sleeve that is attached to said hinge pin and which contains said notch.

4. The assembly as recited in claim 1, wherein said hinge further includes a spring that biases said outer sleeve away from the locked position.

5. The assembly as recited in claim 2, wherein said hinge further includes a spring that biases said button into said notch.

* * * * *